US005460470A

United States Patent [19]

Wilson

[11] Patent Number: 5,460,470

[45] Date of Patent: Oct. 24, 1995

[54] AUTOMATIC STORAGE AND RETRIEVAL SYSTEM

[75] Inventor: Jack S. Wilson, Langley, Canada

[73] Assignee: Gunn Industries Ltd., Aldergrove, United Kingdom

[21] Appl. No.: 899,573

[22] Filed: Jun. 18, 1992

Related U.S. Application Data

[63] Continuation of Ser. No. 558,149, Jul. 26, 1990, abandoned.

[30] Foreign Application Priority Data

May 16, 1990 [CA] Canada ..... 2017054

[51] Int. Cl.[6] ..... E04H 6/12

[52] U.S. Cl. ..... 414/254; 414/263; 414/663

[58] Field of Search ..... 414/263, 253, 414/255, 256, 282, 664, 663, 254, 262, 264; 187/17, 27, 29.2, 110, 111

[56] References Cited

U.S. PATENT DOCUMENTS

| | | | |
|---|---|---|---|
| 1,797,325 | 3/1931 | Chaudoir | 414/263 X |
| 2,598,750 | 6/1952 | Bargehr . | |
| 2,647,647 | 8/1953 | Alimanestiano . | |
| 2,691,448 | 10/1954 | Lontz | 414/263 X |
| 2,838,186 | 6/1958 | Alimanestiano . | |
| 2,899,087 | 8/1959 | Jacobsen . | |
| 2,901,129 | 8/1959 | Sanders . | |
| 2,915,204 | 12/1959 | Alimanestiano . | |
| 3,063,579 | 11/1962 | Alimanestiano . | |
| 3,120,880 | 12/1964 | Jaseph . | |
| 3,395,815 | 8/1968 | Johnson | 414/263 X |
| 3,439,815 | 4/1969 | Wagner | 414/263 X |
| 3,498,415 | 3/1970 | Wright . | |
| 3,556,329 | 1/1971 | Johnston et al. | 414/663 |
| 4,039,089 | 8/1977 | Kochanneck | 414/263 X |
| 4,265,581 | 5/1981 | Ives et al. | 414/263 X |
| 4,804,302 | 2/1989 | Andre . | |
| 4,807,723 | 2/1989 | Salmon et al. . | |
| 4,976,580 | 12/1990 | Knakrick | 414/263 X |
| 5,049,022 | 9/1991 | Wilson | 414/253 |

FOREIGN PATENT DOCUMENTS

| | | | |
|---|---|---|---|
| 0350464 | 1/1990 | European Pat. Off. | 414/263 |
| 1127134 | 8/1956 | France . | |
| 1291812 | 3/1962 | France . | |
| 1527570 | 5/1968 | France | 414/664 |
| 1000987 | 6/1957 | Germany . | |
| 0034238 | 3/1978 | Japan | 414/663 |
| 1296443 | 11/1972 | United Kingdom | 414/663 |
| 8602687 | 5/1986 | WIPO | 414/263 |

*Primary Examiner*—Michael S. Huppert
*Assistant Examiner*—J. Eller
*Attorney, Agent, or Firm*—Elbie R. de Kock; John R. Uren

[57] ABSTRACT

A storage and retrieval system such as can be used as a parking bay structure is provided which comprises a hydraulically operated skip hoist system and which includes a skip hoist shaft and a skip which is hoistable up and down the shaft. A plurality of parking bays are located around the skip hoist shaft. A pair of shuttles are located on the skip and are moveable relative to the skip for positioning vehicles on and removing vehicles from the parking bays. The shuttles are located on a rotunda on the skip which is rotatable about a vertical axis for rotating the shuttles to align the shuttles with the parking bays surrounding the skip hoist shaft.

8 Claims, 11 Drawing Sheets

AUTOMATIC STORAGE AND RETRIEVAL SYSTEM

This application is a continuation of U.S. patent application Ser. No. 07/558,149, filed Jul. 26, 1990, now abandoned.

INTRODUCTION

This invention relates to a method and apparatus for the automatic storage and automatic retrieval of articles to and from storage modules, such as motor vehicles in a multilevel parking structure.

BACKGROUND OF THE INVENTION

In applicant's U.S. patent application No. 07/305,855, now U.S. Pat. No. 5,049,022 a parking structure is described which can be erected as a portable structure on a vacant lot. The structure comprises a skip which can be hoisted up and down a shaft. Parking slot modules are provided on opposite sides of the shaft and spaced at different levels along the length of the shaft. The skip has a shuttle thereon for moving vehicles to and from the parking slot modules in an automatic fashion under computer control.

Other parking structures are also known, for example, as disclosed by U.S. Pat. Nos. 2,899,087 and 2,901,129, which have elevators for moving vehicles up and down a shaftway and moving vehicles to and from parking storage modules at different levels along the shaft.

It is a disadvantage of the elevators of these parking structures that they are capable only of addressing parking storage slots which are effectively located at opposite ends of the skip, i.e. the front or rear ends thereof. Therefore, the elevator's capability of addressing parking storage slots is limited to two in front and two at the rear if two shuttles are provided on the skip. This particularly becomes a problem where only limited space is available for installation of the parking structure.

SUMMARY OF THE INVENTION

According to the invention, there is provided a method of positioning an article in a storage module, which comprises the steps of positioning said article on a shuttle; rotating the shuttle until the shuttle is aligned with the storage module; and moving the article from the shuttle into the storage module.

Also according to the invention there is provided a hydraulically powered skip hoist system, which comprises a skip hoist shaft; a skip which is vertically moveable within the skip hoist shaft; a plurality of storage slot modules located around the skip hoist shaft; a shuttle on the skip moveable relative to the skip for positioning articles on and removing articles from the storage slot modules; wherein the shuttle is rotatable about a vertical axis for rotating the shuttle to align the shuttle with one of said storage slot modules. In this way, by rotating the shuttle about a vertical axis, it is possible to align storage slot modules which are located around the skip hoist shaft and up to eight or more storage slot modules can be addressed by each shuttle.

Further objects and advantages of the invention will become apparent from the description of a preferred embodiment of the invention below.

DESCRIPTION OF THE DRAWINGS

The invention will now be described, by way of an example, with reference to the accompanying drawings, in which.

DETAILED DESCRIPTION OF A PREFERRED EMBODIMENT

Figure 12:
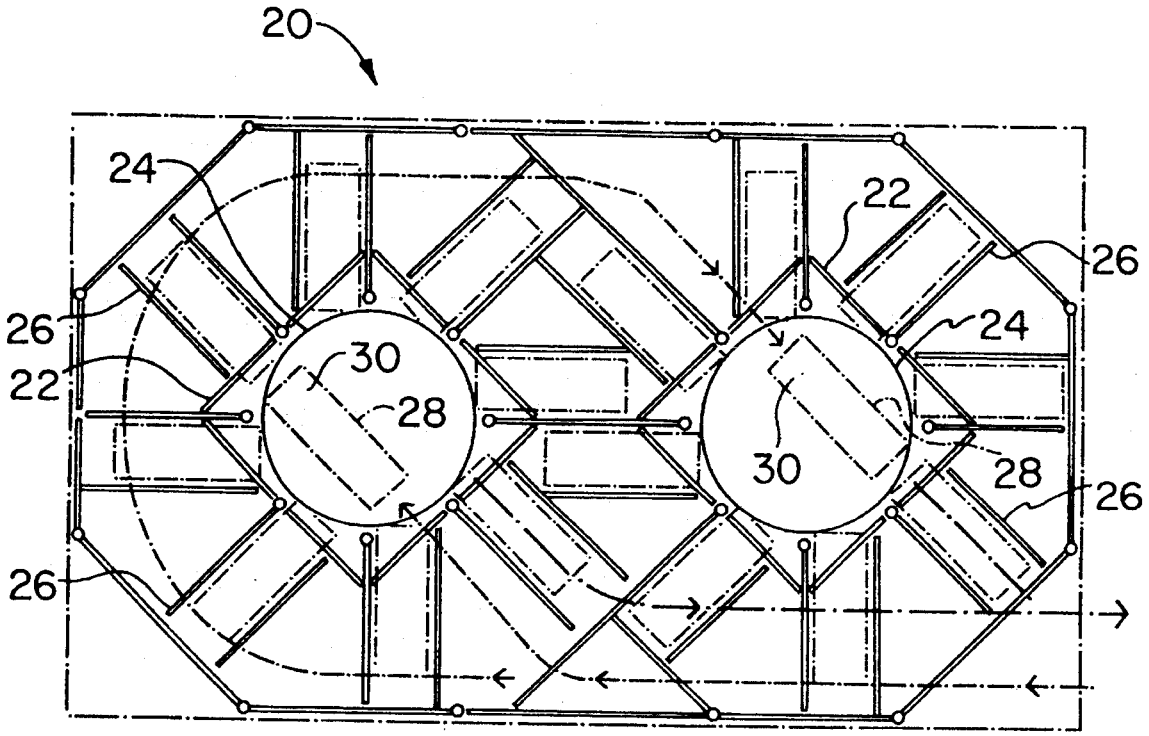
FIG. 12 is a plan view of a parking structure layout according to one embodiment of the invention.

Referring first to FIG. 12, a parking structure 20 according to one embodiment of the invention is shown, which comprises a pair of skip hoist shafts 22, located side by side, a skip 24 for each shaft 22 which is vertically moveable within the shaft 22 and eight parking bays 26 surrounding each shaft 22. A pair of shuttles 28 are located side by side on each skip 24. For simplicity, only one shuttle 28 is shown on each skip 24 in FIG. 12. Each shuttle 28 is moveable relative to the skip 24 for positioning a motor vehicle 30 on and removing same from a parking bay 26, as will be described in more detail below. The general method of construction of the structure comprising the skip hoist shafts 22 and the parking bays 26 has been described in U.S. Pat. No. 5,049,022, the contents of which has been incorporated herein by reference, and will not be repeated here.

Figure 1:
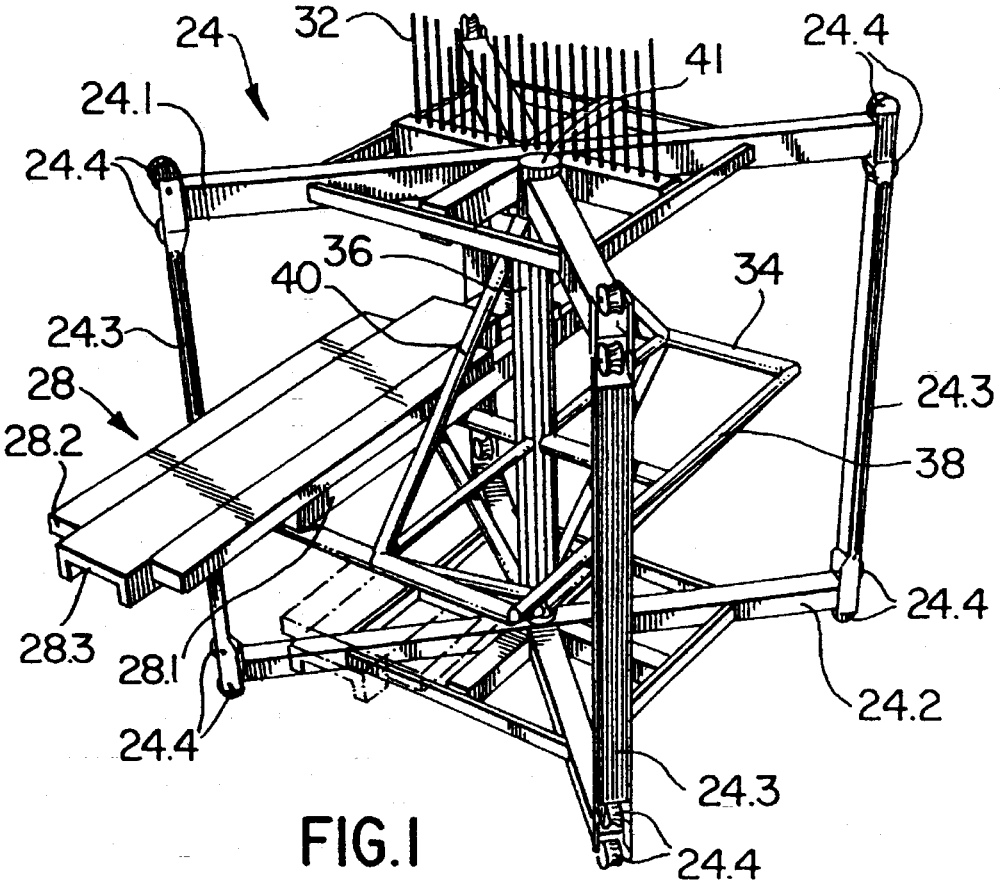
FIG. 1 is a three-dimensional view of a skip, with a rotunda at its centre, of a parking structure according to the invention.
Figure 6:
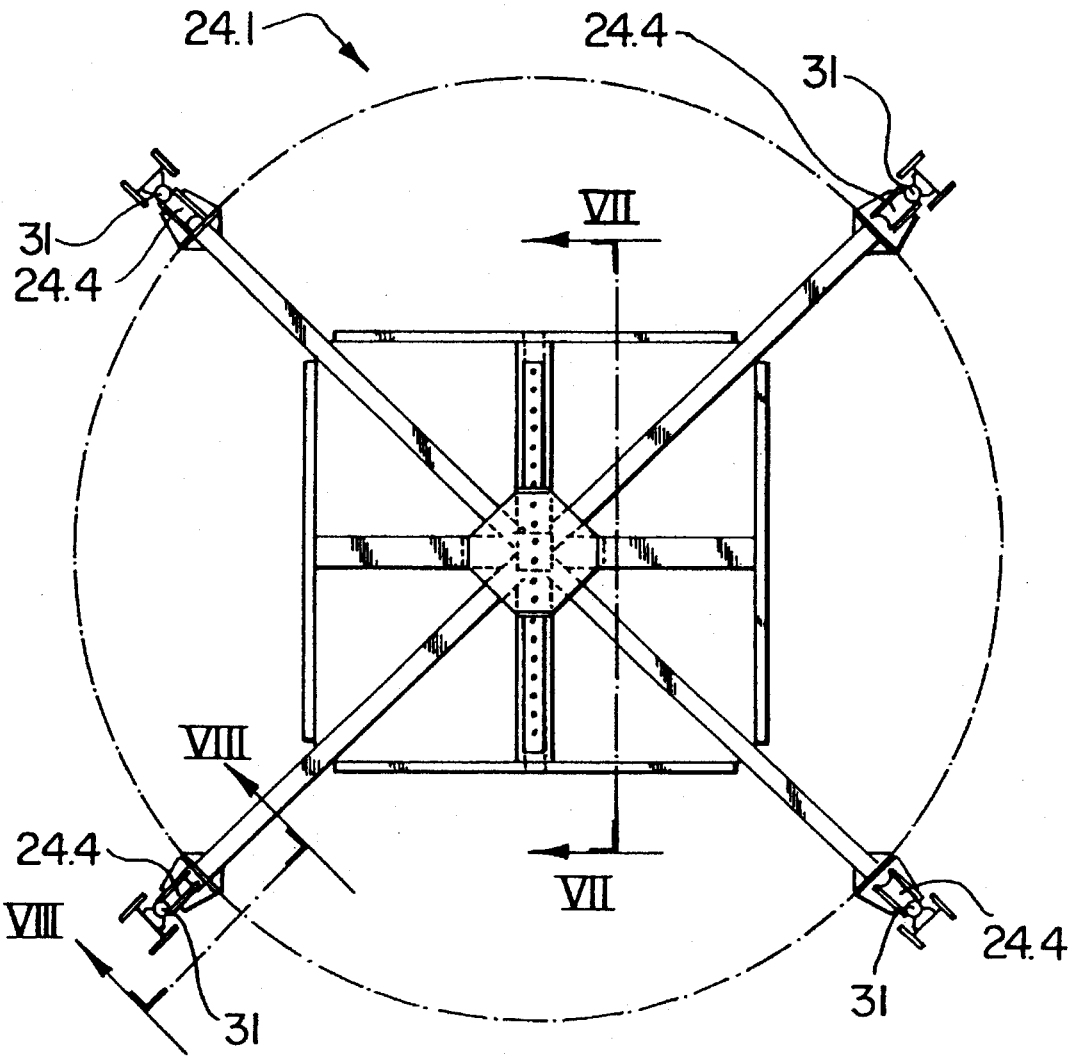
FIG. 6 is a plan view of a top frame part of the rotunda of FIG. 1.
Figure 8:
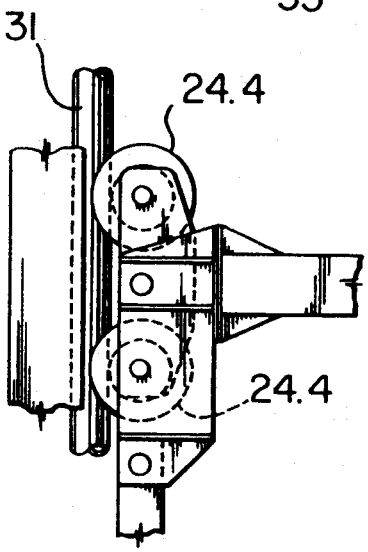
FIG. 8 is a section taken along the lines VIII—VIII in FIG. 6.
Figure 10:
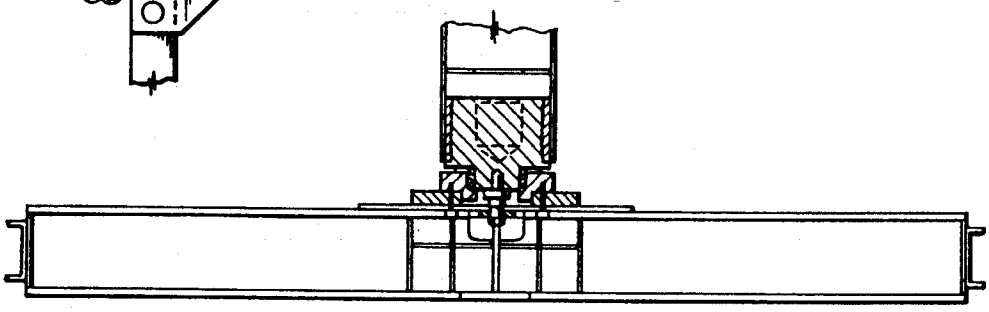
FIG. 10 is a section taken along the lines X—X in FIG. 9.
Figure 11:
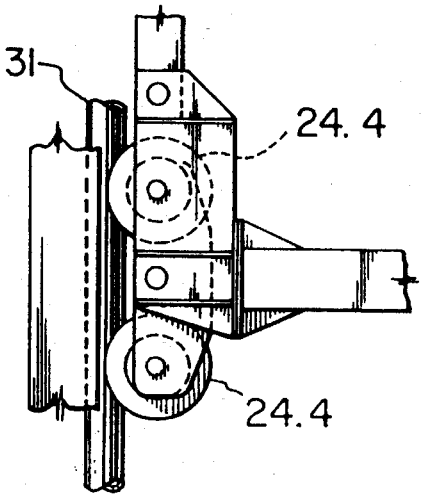
FIG. 11 is a section taken along the lines XI—XI in FIG. 9.
Figure 9:
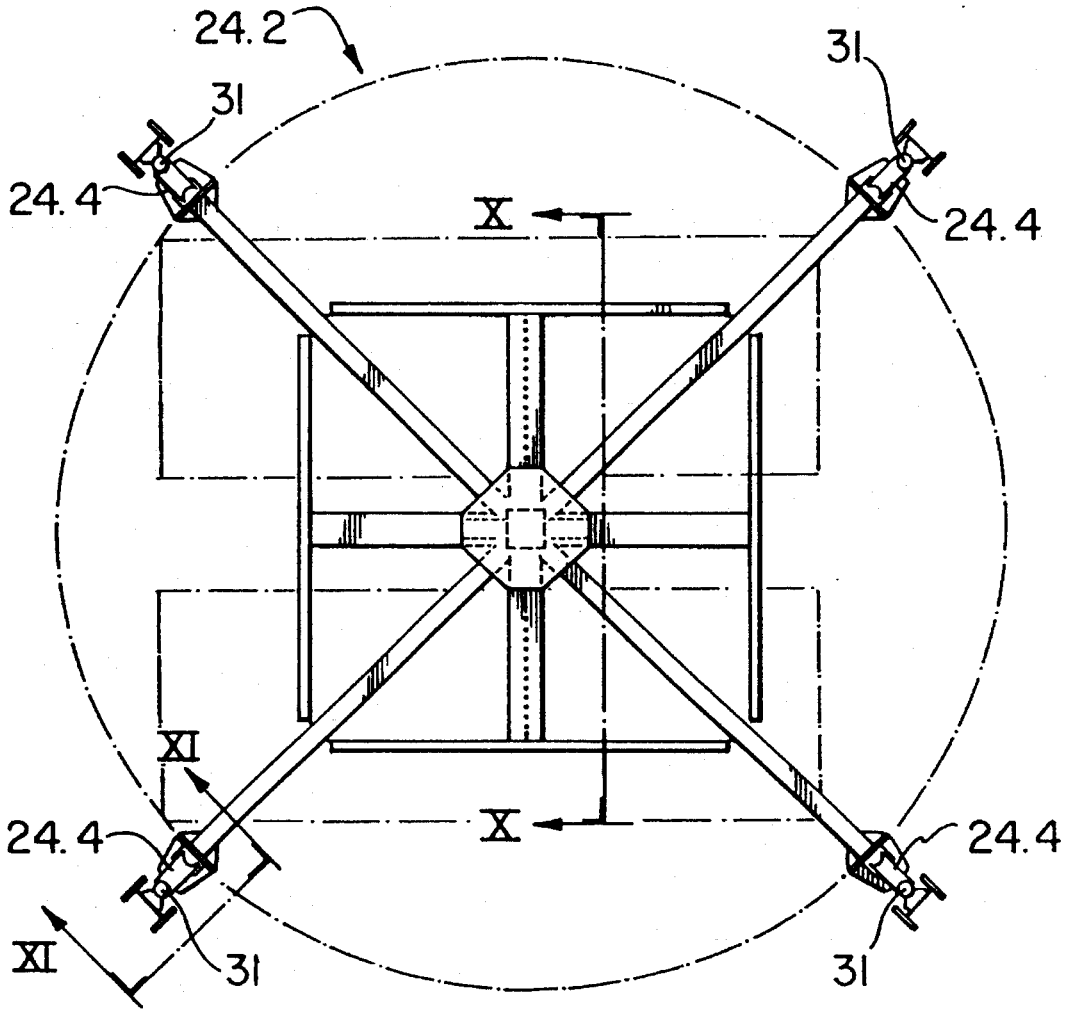
FIG. 9 is an underneath plan view of a bottom frame part of the skip of FIG. 1.

Referring now to FIG. 1, the skip 24 is illustrated in more detail. It comprises a top frame part 24.1 and a bottom frame part 24.2 connected together by vertical frame members 24.3. Concave contour wheels 24.4 are provided on the top and bottom frame parts 24.1, 24.2 for rolling on guide tubes 31 on the skip hoist shaft 22. The construction of the wheels 24.4 and interaction with the guide tubes 31 are more clearly illustrated in FIGS. 8 and 11, for the top and bottom parts of the skip respectively. A plan view and underneath plan view of the top and bottom frame parts 24.1, 24.2 of the skip 24 are also illustrated in FIGS. 6 and 9, respectively.

Figure 7:
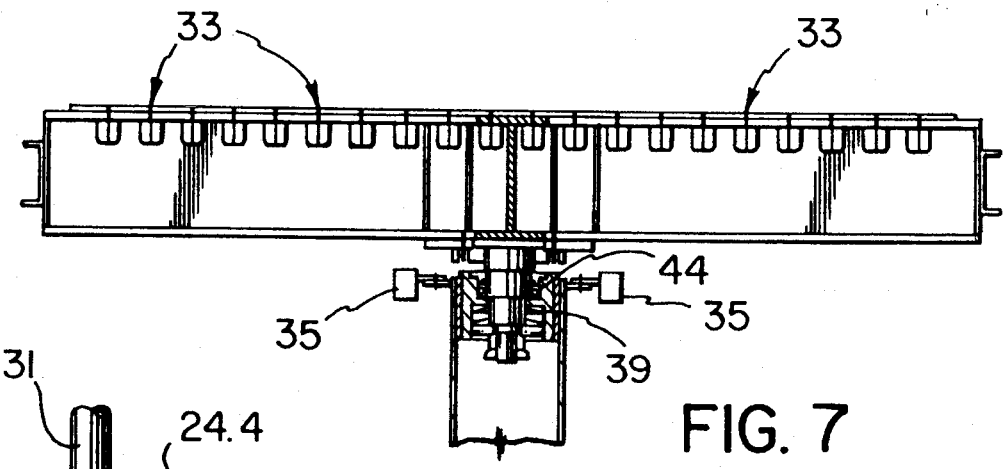
FIG. 7 is a section taken along the lines VII—VII in FIG. 6.

Cables 32 of a multi-wire traction hoist system, which is fully described in U.S. Pat. No. 5,049,022, are connected to the top frame part 24.1 of the skip 24, which includes a hoist strongback for this purpose. The strongback part to which the cables 32 are connected is shown in cross-section in FIG. 7. The positions to which the cables 32 are connected are indicated at 33. A rotunda 34 (FIGS. 1 and 4) is located at the centre of the skip 24 and it has a central member 36 which is rotatable relative to the skip 24 about a central vertical axis. A rectangular framework 38 is provided on the member 36 and is supported by means of inclined struts 40 depending from the central member 34. In FIG. 7, reference numeral 35 indicates a split slewing gear which is driven by a drive 41 (FIG. 4) for rotating the rotunda 34 about the central axis. The gear 35 interacts with another gear 37 which is driven by the drive 41. Reference numeral 44 (FIG. 7) indicates a spherical thrust hanger bearing and reference numeral 39 indicates a spherical hanger on the rotunda 34.

Figure 4:
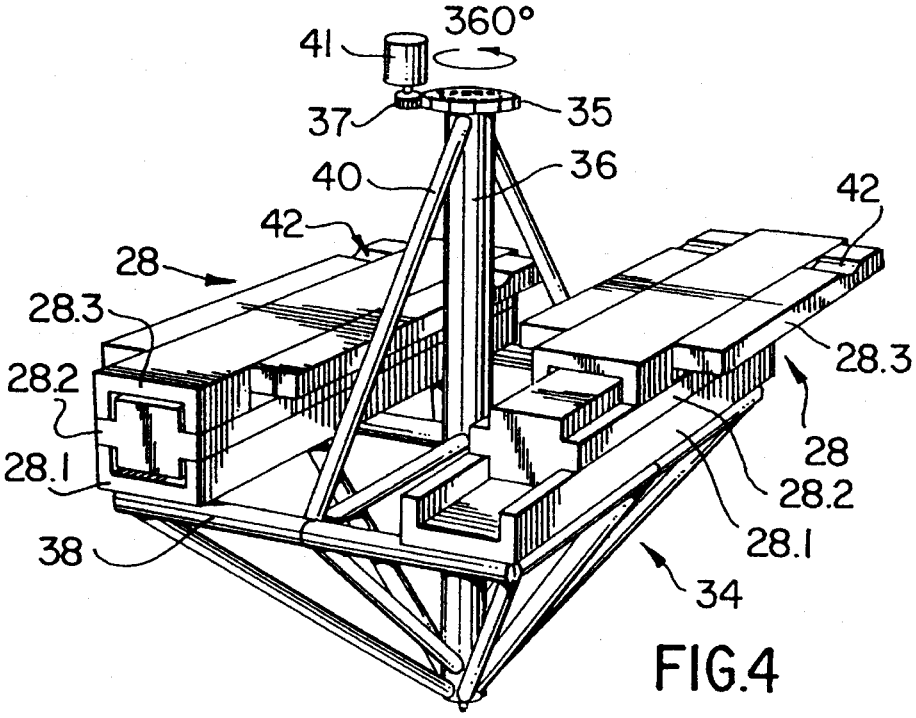
FIG. 4 is a three-dimensional view of the rotunda of the skip of FIG. 1 and also illustrating two bi-directional shuttles located thereon.

The pair of shuttles 28 which are provided on the rotunda 34 are shown in more detail in FIG. 4. Each comprises a base member 28.1, a middle slide 28.2 and a top slide 28.3. The middle slide 28.2 is slidable relative to the base 28.1 and the top slide 28.3 is slidable relative to the middle slide 28.2 and base 28.1. Each shuttle 28 is, therefore, moveable between a retracted position, as shown on the left hand side of FIG. 4, and an extended position, as shown on the right hand side of FIG. 4. In FIG. 1 the shuttle 28 is shown only partially extended. The construction and operation of the shuttles 28 are fully described in U.S. Pat. No. 5,049,022 and will not be repeated here.

The top slide 28.3 of each shuttle 28 comprises a plurality of fingers, as described in U.S. Pat. No. 5,049,022. Likewise, the parking bays 26 comprise vehicle supporting parts provided with fingers which are adapted to mesh with the fingers on the top slide 28.3 for placing and removing a vehicle from a parking bay as described in the above-mentioned prior application. The top slide 28.3 is also provided with wheel chock pockets 42 as shown in FIG. 4. The chock pockets 42 are shown diagrammatically as semi-circular recesses in the drawing, but in fact they are simply formed by increasing the distance between adjacent fingers on the top slide 28.3, so that the vehicle wheel is anchored by being partially received in the recess formed by the increased spacing between the adjacent fingers. Wheel chock pockets are provided in a similar fashion in the vehicle supporting parts of each parking bay 26, i.e. by increasing the distance between adjacent fingers on the vehicle supporting parts. No mechanical wheel locks are therefore required.

The rotunda 34 is provided with the spherical thrust hanger bearing 44 to provide for the entire weight and load of the skip 34 to be supported from above and so that it is not carried by the bottom frame part 24.2 of the skip 24.

Figure 5:
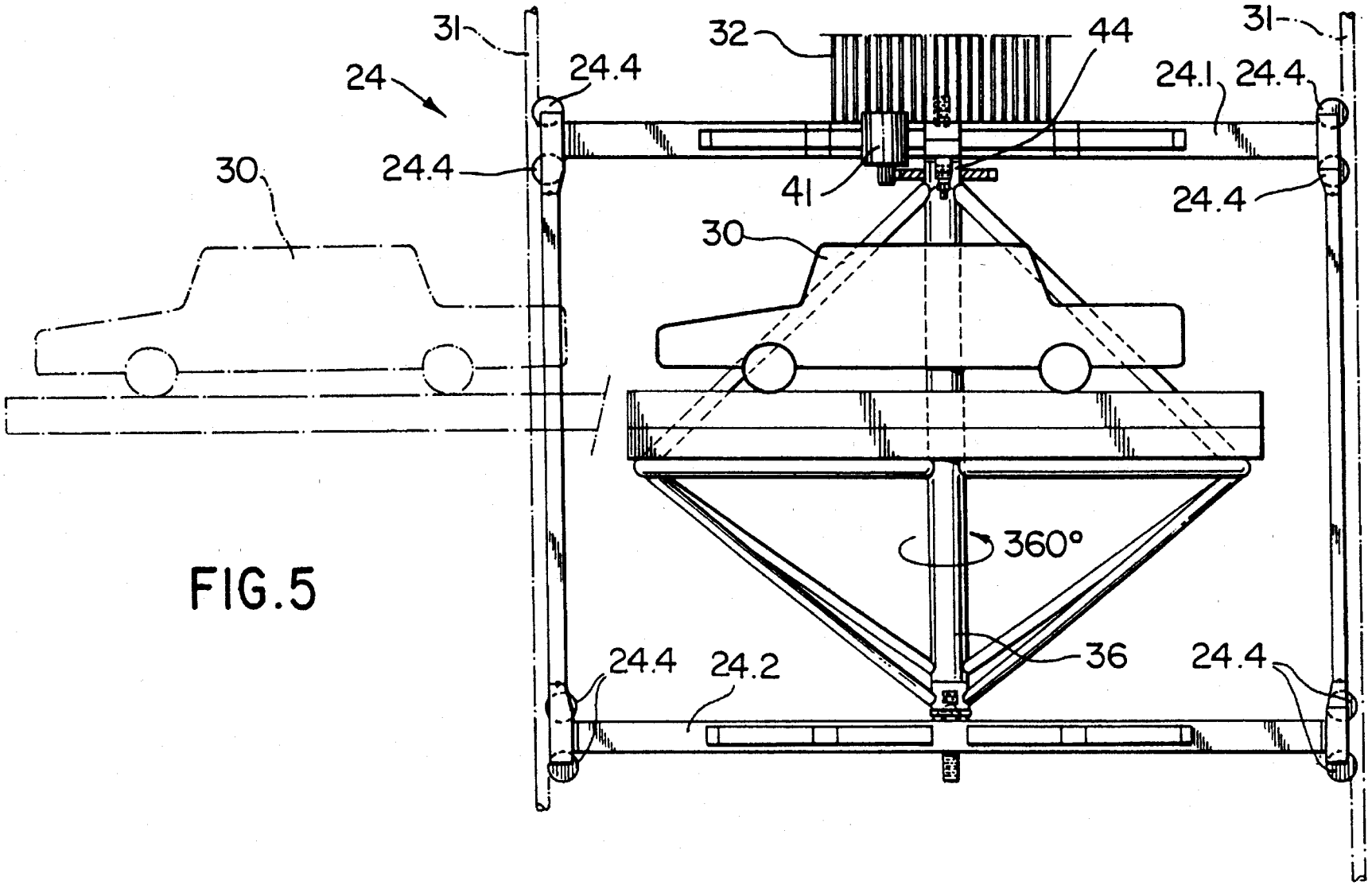
FIG. 5 is a side view of the skip of FIG. 1 and illustrating a motor vehicle located thereon.

In FIG. 5, the two extreme positions of the shuttle 28 are indicated. The retracted or "home" position is shown in solid lines, in which the vehicle 30 is located on the rotunda 34, and the extended position is shown in broken lines, in which the vehicle 30 is in position for placing in a parking bay.

Figure 2:
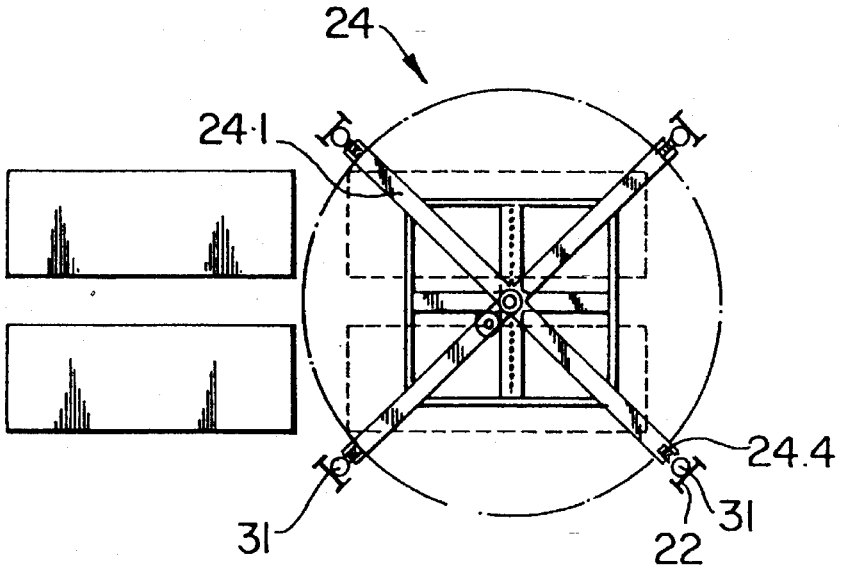
FIG. 2 is a plan view of the skip of FIG. 1 and illustrating the positions which can be indexed by a shuttle on the skip.
Figure 3:
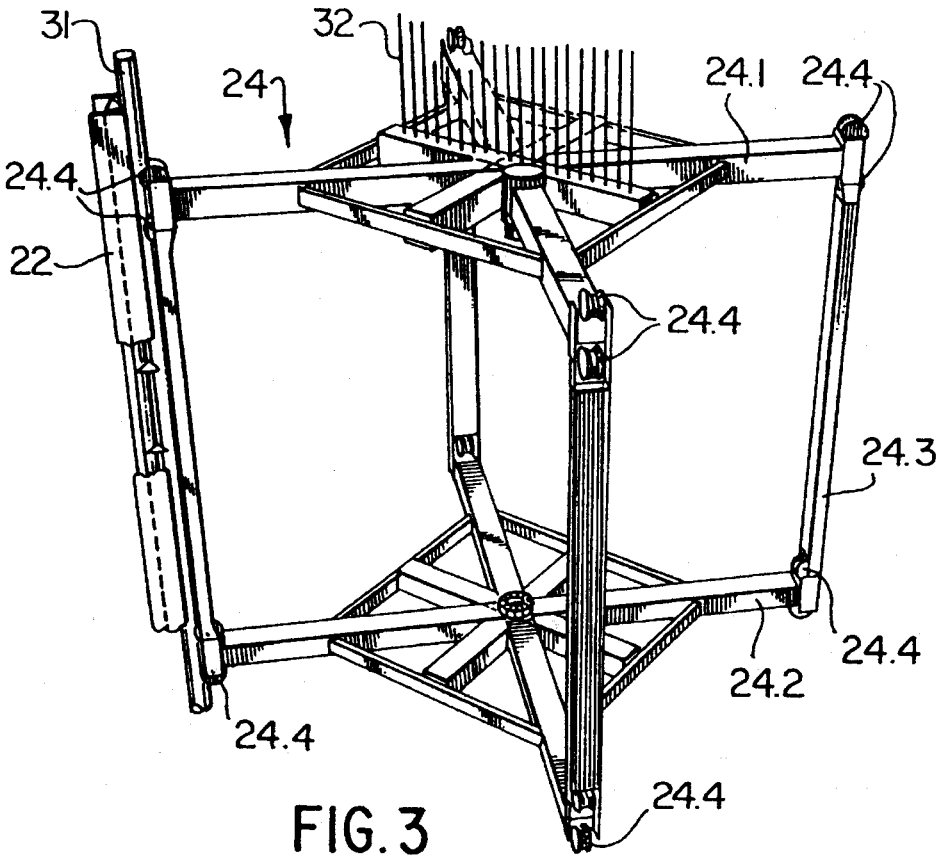
FIG. 3 is a three-dimensional view of the skip of FIG. 1 but with the rotunda at the centre thereof omitted.

The rotunda 34 is rotatable around 360° by means of the drive 41 and, in this particular embodiment, it has a possible eight index positions as indicated by the encircled numbers from 1 to 8 in FIGS. 2 and 3. Also in each of these figures, the directions of travel of each of the two shuttles 28 in each of the eight index positions of the rotunda 34 are indicated by the arrows marked "S1" and "S2".

Figure 13:
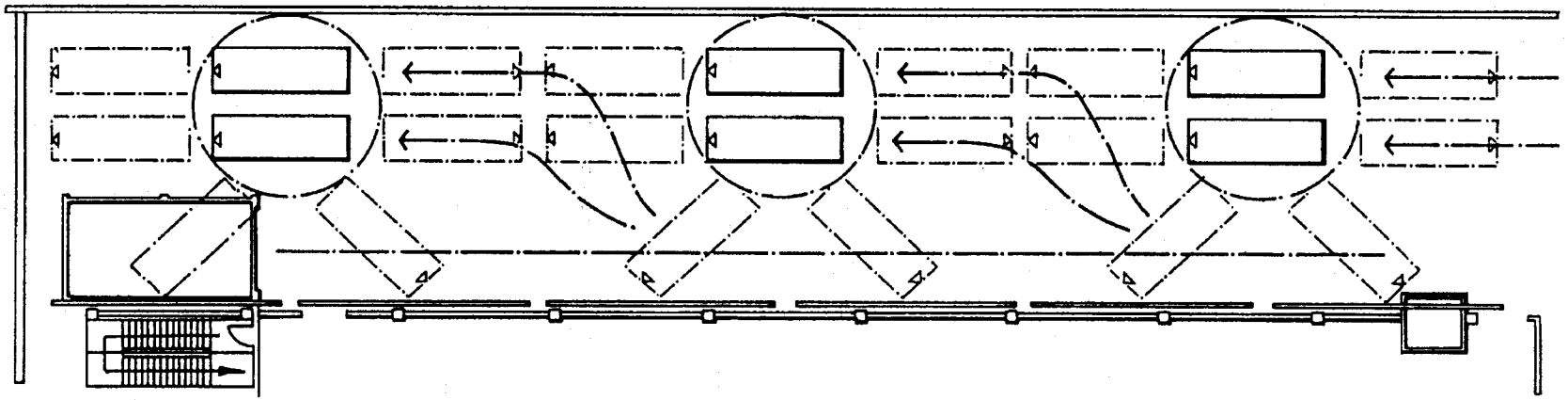
FIG. 13 illustrates a parking structure layout according to another embodiment of the invention.
Figure 14A:
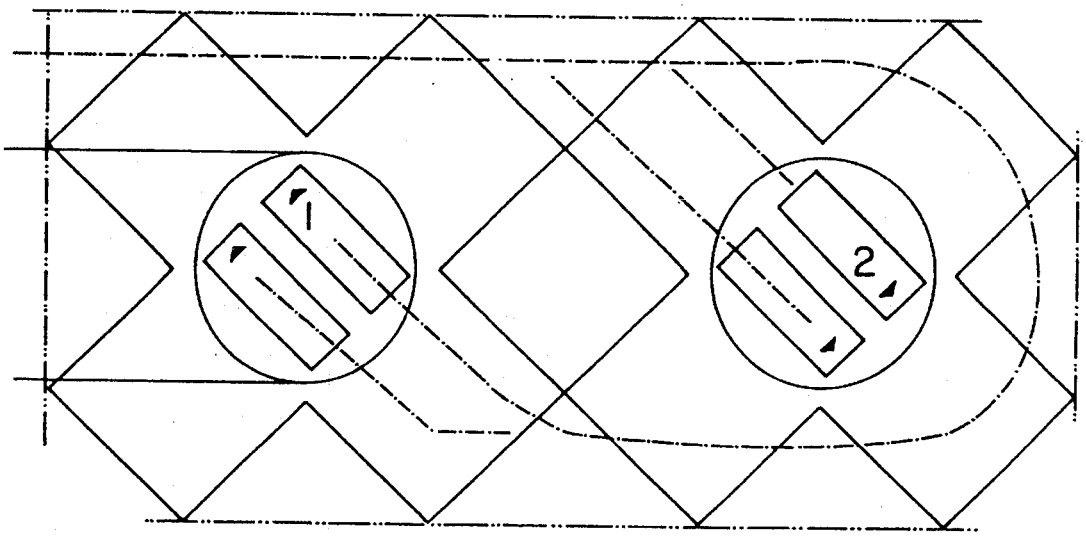
FIGS. 14A and 14B illustrate a parking structure layout according to a further embodiment of the invention.
Figure 14B:
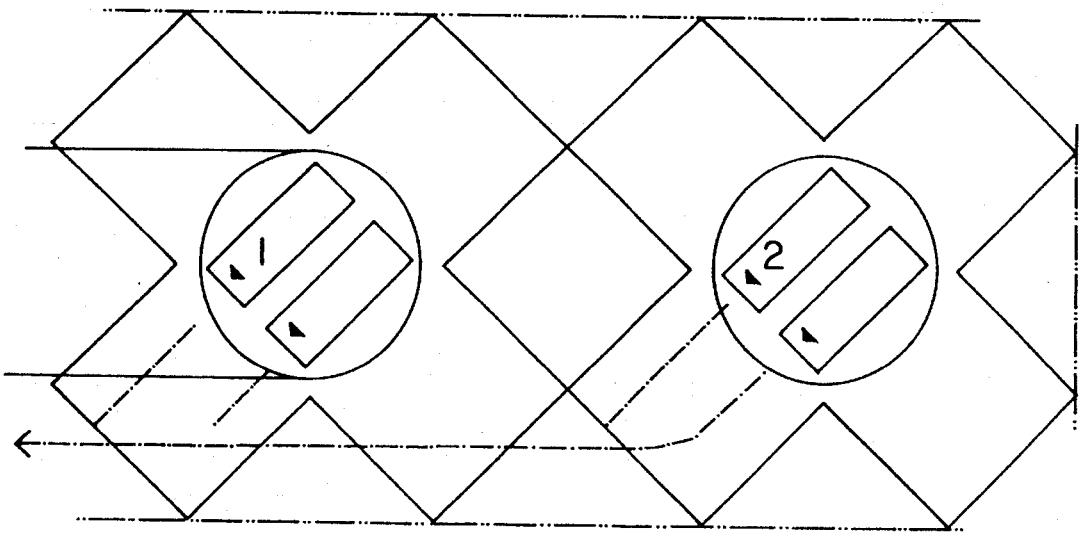
Figure 15A:
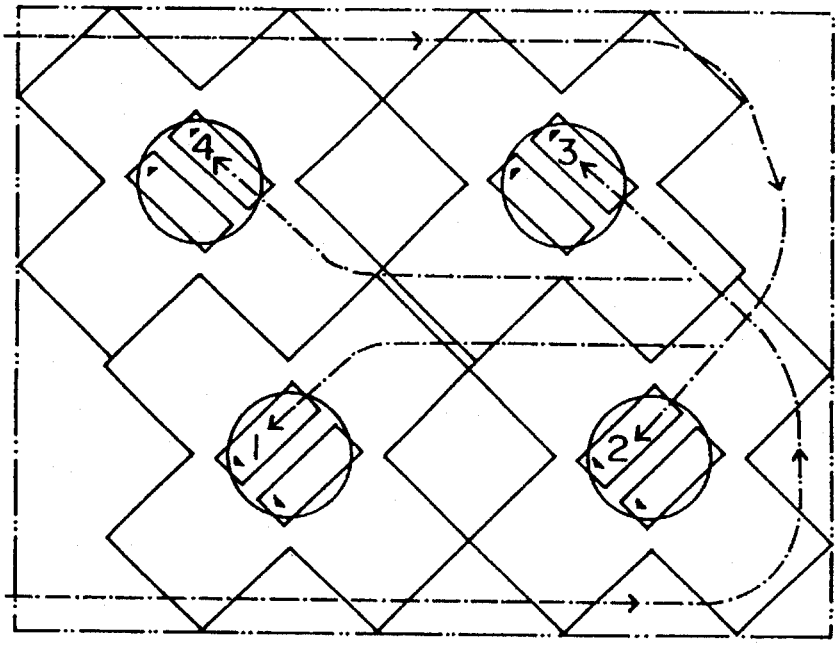
FIGS. 15A and 15B illustrate a parking structure layout according to another embodiment of the invention.
Figure 15B:
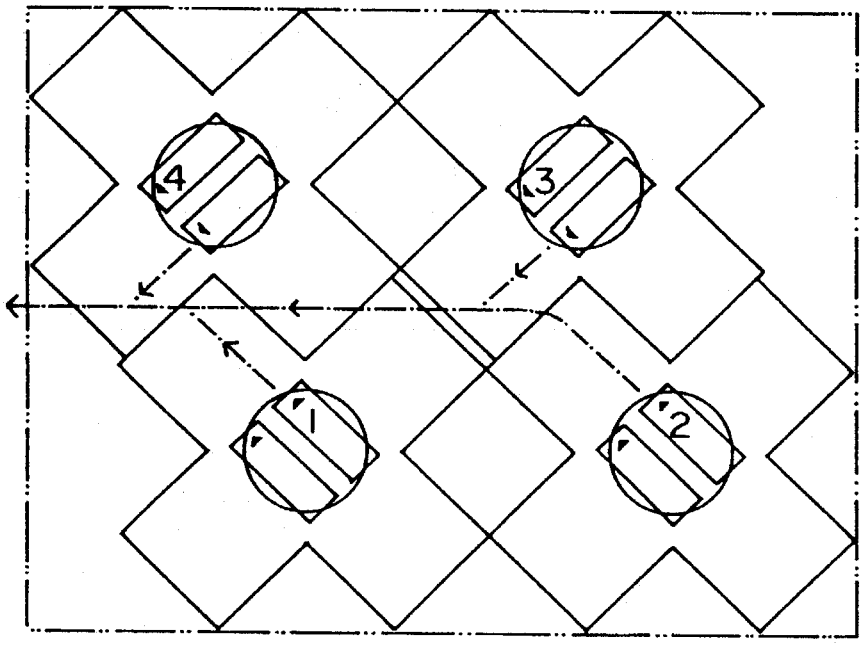
Figure 16A:
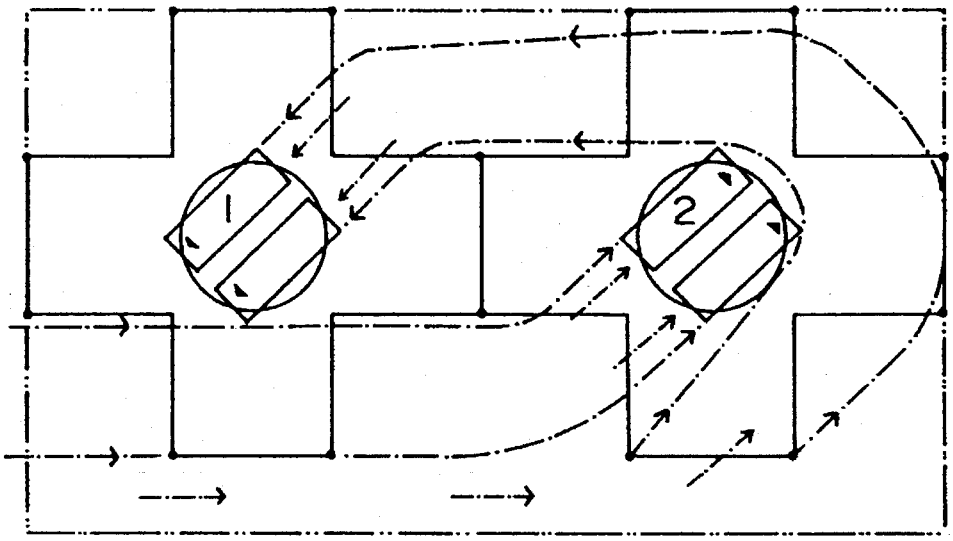
FIGS. 16 A and B illustrate a parking structure layout according to yet a further embodiment of the invention.
Figure 16B:
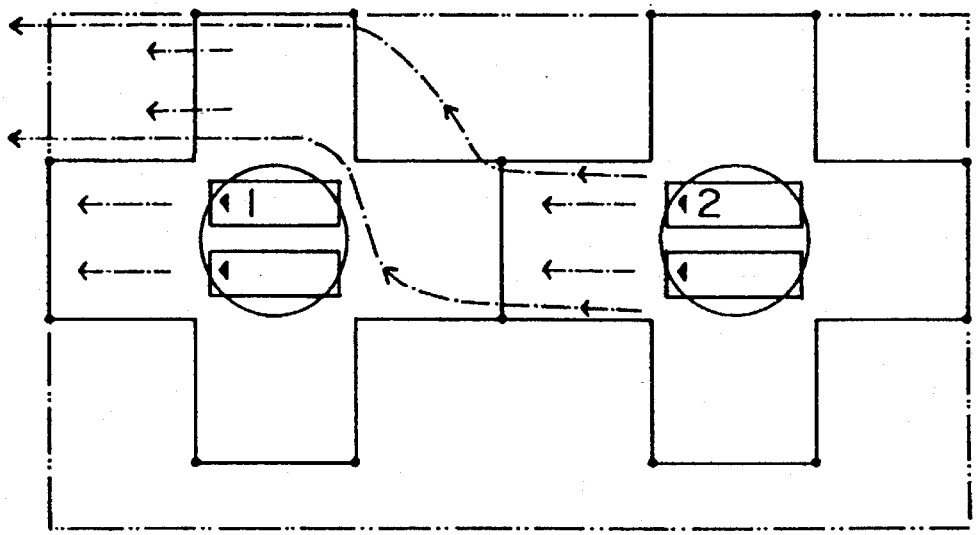

The parking bays 26 are arranged around the shaft 22 to correspond with the index positions and various different types of arrangement of the parking bays 26 are possible, depending on requirements and available space. In the embodiment illustrated in FIG. 12, the arrangement is such that either one or the other of the two shuttles 28 on the skip 24 can address a parking bay 26 in each of the eight possible index positions. With this arrangement the two shafts 22 can be located at a minimum distance away from each other with the parking bays merged for maximum utilization of available space. With the arrangement shown in FIGS. 14 A and B, only four index positions are utilized and each shuttle 28 can address a parking bay in each of the four index positions. In this arrangement, the parking bays are not merged and two shafts 22 side by side are utilized. FIG. 14A illustrates, by means of the broken lines and arrows the directions of entry of motor vehicles into the structures, whilst FIG. 14B illustrates the directions of exit. In the embodiment shown in FIGS. 15 A and B, the arrangement is the same except that two further shafts are added which are staggered with respect to the first two shafts so that at least partial merging of the parking bays is achieved. The directions of entry and exit are again illustrated by the broken lines and arrows in FIGS. 15A and B, respectively. In FIGS. 16 A and B, a different variation of the arrangement shown in FIGS. 14 A and B is shown where the parking bays of adjacent shafts 22 are located in an end-to-end relationship, the entry and exit directions again being illustrated by the A and B figures, respectively. The arrangement illustrated in FIG. 13 is particularly suitable for use on a vacant lot which is long and narrow.

OPERATION

The operation of the parking structure has been described in the U.S. Pat. No. 5,049,022 and applies here as well, except for the further feature that the shuttles 28 can now also be rotated to align the various different parking bay positions surrounding the skip hoist shaft 22. In addition, the wheel chock pockets 42 provided in the top slides 28.3 as well as in the vehicle supporting parts of the parking bays 26, retain a vehicle in position during transportation to and from a parking bay 26, as well as during storage in a parking bay 26.

While the invention has been described as a parking structure, it will be appreciated that the structure can also be used for the storage and retrieval of various other items, particularly items with larger dimensions, such as loading ore containers, pleasure boats, tote boxes, baggage bins, food chests and the like.

Another important feature of the invention which is described and illustrated in U.S. Pat. No. 5,049,022 is that it incorporates a multimotor hydraulic drive system which is powered by a single power source. Each skip hoist shaft is provided with its own drive but they are powered by a single power source. Up to four drives can be powered in this way. This is facilitated by the fact that, whilst the skip in one shaft may be going up, the skip in another shaft may be going down, thus generating power back into the system.

A further important feature of the invention is the multi-telescoping slides of the shuttles 28, comprising slides 28.2 and 28.3 which are moveable relative to each other, as well as to the base 28.1. The mechanism of driving the slides has been described and illustrated in U.S. Pat. No. 5,049,022. The slides 28.2 and 28.3 can travel at different speeds. The slides are bi-directional and can telescope up to 20 feet at each of the opposite ends of the shuttle 28.

A further feature of the invention is that the storage and retrieval operations described above are performed automatically under microprocessor and PLC control as described in U.S. Pat. No. 5,049,022.

While only preferred embodiments of the invention have been described herein in detail, the invention is not limited thereby and modifications can be made within the scope of the attached claims.

What is claimed is:

1. A skip hoist system, which comprises:

a skip hoist shaft;

a skip which is vertically moveable within the skip hoist shaft;

a plurality of storage slot modules located around the skip hoist shaft;

a shuttle on the skip moveable relative to the skip for positioning articles on and removing articles from the storage slot modules;

wherein the shuttle is rotatable about a vertical axis for rotating the shuttle to align the shuttle with a selected one of said storage slot modules; and wherein the shuttle comprises a base, a middle slide cantilevered to the base and movable relative thereto, a top slide cantilevered to the middle slide and movable relative thereto and drive means mounted on said base and being operable to move said middle slide relative to said base and said top slide relative to said base and said middle slide, whereby said top slide is moved from a retracted position over said base to an extended position in which the top slide freely overhangs the selected one of said storage slot modules; and wherein each storage slot module comprises article support means for supporting an article in the storage slot module, said article support means and the top slide of the shuttle each being provided with a plurality of fingers which mesh with each other for positioning articles on and removing articles from storage slot modules; and wherein the article support means comprises a pair of article support members located in parallel spaced relationship with respect to each other and wherein the top slide of the shuttle is moveable between the article support members during said meshing of the fingers, and further comprising means for moving said skip a predetermined distance up or down relative to the article support means to effect said movement of the top slide between the article support members during said meshing of the fingers.

2. The skip hoist system according to claim 1, wherein a plurality of said storage slot modules are located at each of a plurality of different vertical levels along the skip hoist shaft.

3. The skip hoist system according to claim 2, wherein a plurality of said shuttles are provided on the skip and rotatable with the skip.

4. The skip hoist system according to claim 3, wherein two of said shuttles are provided on the skip.

5. The skip hoist system according to claim 1, wherein said plurality of storage slot modules consists of eight of said storage slot modules located around the skip hoist shaft.

6. The skip hoist system according to claim 1, comprising a plurality of said skip hoist shafts and a plurality of said skips, a skip being vertically moveable within each skip hoist shaft and each skip hoist shaft having a plurality of said storage slot modules associated therewith.

7. The skip hoist system according to claim 6, comprising a hydraulic motor for each of said skips for lifting said skips, a connection extending between each of said skips and said respective hydraulic motor and a common hydraulic pump connected to said hydraulic motors for driving the motors.

8. The skip hoist system according to claim 1, wherein the system is a parking structure for motor vehicles.

* * * * *

UNITED STATES PATENT AND TRADEMARK OFFICE

CERTIFICATE OF CORRECTION

PATENT NO. : 5,460,470

DATED : October 24, 1995

INVENTOR(S) : Wilson, Jack S.

It is certified that error appears in the above-identified patent and that said Letters Patent is hereby corrected as shown below:

On the title page: Item 73), change

"Gunn Industries Ltd., Aldergrove, United Kingdom" to

--Gunn Industries Ltd., Aldergrove, Canada--

Signed and Sealed this

Fifth Day of March, 1996

*Attest:*

Bruce Lehman

BRUCE LEHMAN

*Attesting Officer*

*Commissioner of Patents and Trademarks*